US007805944B2

(12) United States Patent
Garry et al.

(10) Patent No.: US 7,805,944 B2
(45) Date of Patent: Oct. 5, 2010

(54) COMBUSTION CHAMBER AIR INLET

(75) Inventors: Ian Murray Garry, Leicestershire (GB); Michael Lawrence Carlisle, Derby (GB)

(73) Assignee: Rolls-Royce PLC (GB)

( * ) Notice: Subject to any disclaimer, the term of this patent is extended or adjusted under 35 U.S.C. 154(b) by 0 days.

(21) Appl. No.: 11/945,289

(22) Filed: Nov. 27, 2007

(65) Prior Publication Data

US 2008/0134682 A1 Jun. 12, 2008

(30) Foreign Application Priority Data

Dec. 12, 2006 (GB) ..... 0624720.9

(51) Int. Cl.
*F02C 1/00* (2006.01)

(52) U.S. Cl. ..... 60/752; 60/759

(58) Field of Classification Search ..... 60/752, 60/759, 755, 757

See application file for complete search history.

(56) References Cited

U.S. PATENT DOCUMENTS

| | | | | |
|---|---|---|---|---|
| 2,916,878 | A * | 12/1959 | Wirt | 60/759 |
| 4,315,405 | A * | 2/1982 | Pidcock et al. | 60/752 |
| 6,351,949 | B1 | 3/2002 | Rice et al. | |
| 7,024,862 | B2 * | 4/2006 | Miyake et al. | 60/773 |

FOREIGN PATENT DOCUMENTS

| | | |
|---|---|---|
| GB | 2353589 A | 2/2001 |

* cited by examiner

*Primary Examiner*—William H Rodríguez
*Assistant Examiner*—Vikansha S Dwivedi
(74) *Attorney, Agent, or Firm*—McCormick, Paulding & Huber LLP

(57) ABSTRACT

A combustor assembly comprising a combustor liner having an opening and a combustor chute, which is formed of a sheet material which is bent to form the desired chute. The chute allows the passage of cooling and dilution air into the combustor.

10 Claims, 4 Drawing Sheets

COMBUSTION CHAMBER AIR INLET

CROSS-REFERENCE TO RELATED APPLICATION

This application is entitled to the benefit of British Patent Application No. GB 0624720.9 filed on Dec. 12, 2006.

FIELD OF THE INVENTION

This present invention relates to combustion apparatus and more particularly to the air inlets or chutes, which direct air flow into combustion chambers for use in gas turbine engines.

BACKGROUND OF THE INVENTION

It is desirable to achieve both a greater aerodynamic efficiency and increased power output per unit weight for a gas turbine. Both efficiency and engine performance can be obtained by increasing the temperature of the hot working fluid. Theoretically, a gas turbine engine could operate at stoichiometric combustion ratios to extract the greatest possible energy from the fuel consumed. However, temperatures at stoichiometric and even non-stoichiometric combustion are generally beyond the endurance capabilities of traditional metallic gas turbine engine components.

The hot working fluid in the gas turbine engine results from the combustion of a fuel mixture within a combustor. Air is introduced through an opening in a combustor liner into the combustion chamber to provide the desired fuel mixture. In order to enhance the combustion process, many gas turbine engine designs utilise a metal combustor chute attached to the combustor wall. These are short length sections of tubes that help direct air from the outside of the combustor to the centre, thereby increasing the mixing effectiveness, which beneficially affects emission control and temperature traverse.

The chutes are typically manufactured by casting or by machining from a solid bar. The chutes are attached to the wall of the combustor through the use of a "top hat" flange that sits flush to the outer surface of the wall and internal welds which secure the chute in place.

The current manufacturing process of the chutes, by casting or machining is costly, time consuming, has a long lead time and is not responsive to possible changes in design parameters which may be specified during development. The method of assembly and forming the welds is similarly costly and requires specialist equipment.

SUMMARY OF THE INVENTION

It is an object of the present invention to seek to provide improved combustion apparatus that seeks to address these and other problems.

According to a first aspect of the invention, there is provided a combustor assembly comprising a combustor liner having at least one opening therethrough, said combustor liner defining a space adapted for the combustion of a fuel, a member inserted through the opening and having a first end outside the combustor liner and a second end within the combustor liner and a passageway therethrough adapted for the passage of a fluid into said space, characterised in that the member is formed of a component that is cut to form the desired shape.

Preferably, the member is cut from sheet material and bent to form the passageway.

Preferably, the passageway has an axis and the member extends around the axis characterised in that at least one tab is provided at the first end of the member and the at least one tab is bent to be normal to the axis of the passageway.

The assembly may comprises means to locate the at least one tab to orientate the member in the combustor assembly. Preferably, the means to locate the at least one tab comprises a receptacle.

The member may comprise at least one flap which is located within the combustor liner and which may be bent away from the passageway to secure the member within the combustor assembly.

The member may be formed as a tube, which is cut to a desired length.

Preferably, the cutting is performed by a laser.

Preferably, cooling apertures are formed in the sheet material for allowing fluid to pass for cooling the combustor liner of member.

DETAILED DESCRIPTION OF THE PREFERRED EMBODIMENTS

Figure 1:
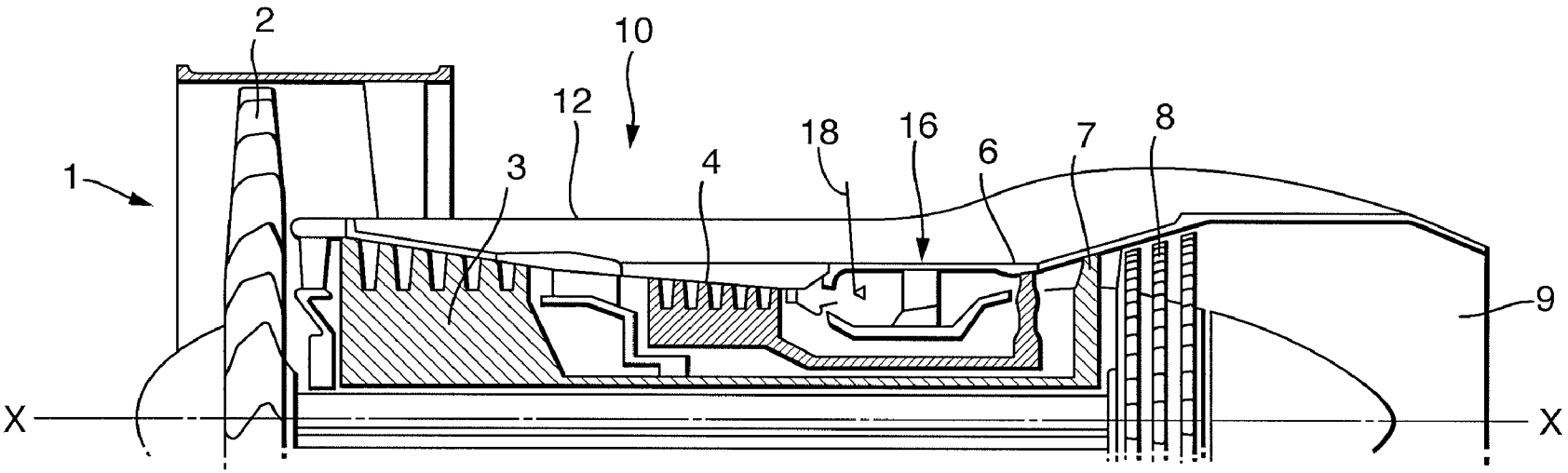
FIG. 1 is a schematic illustration of a gas turbine engine.

With reference to FIG. 1, a ducted fan gas turbine engine generally indicated at 10 comprises, in axial flow series, an air intake 1, a propulsive fan 2, an intermediate pressure compressor 3, a high pressure compressor 4, combustion combustion section 16, a high pressure turbine 6, an intermediate pressure turbine 7, a low pressure turbine 8 and an exhaust nozzle 9.

Air entering the air intake 1 is accelerated by the fan 2 to produce two air flows, a first air flow into the intermediate pressure compressor 3 and a second air flow that passes over the outer surface of the engine casing 12 and which provides propulsive thrust. The intermediate pressure compressor 3 compresses the air flow directed into it before delivering the air to the high pressure compressor 4 where further compression takes place.

Compressed air exhausted from the high pressure compressor 4 is directed into the combustion combustion section 16, where it is mixed with fuel and the mixture combusted. The resultant hot combustion products expand through and thereby drive the high 6, intermediate 7 and low pressure 8 turbines before being exhausted through the nozzle 9 to provide additional propulsive thrust. The high, intermediate and low pressure turbines respectively drive the high and intermediate pressure compressors and the fan by suitable interconnecting shafts.

Figure 2:
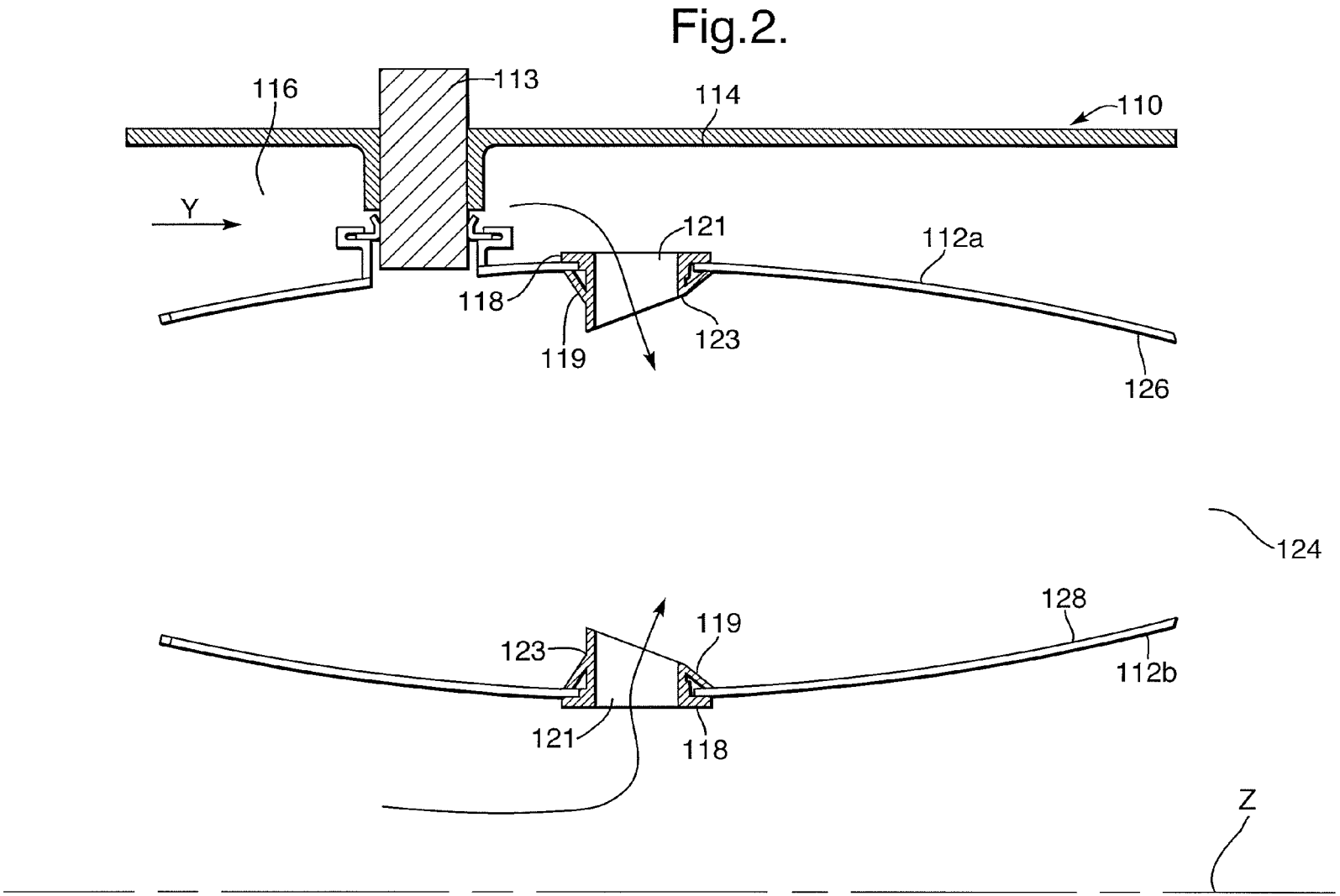
FIG. 2 is a schematic illustration of a combustor comprising air inlet chutes.

Referring to FIG. 2, there is illustrated a partial sectional view of the combustor section 16. The combustor apparatus 110 comprises a mechanical housing/case 114, an igniter 113, an outer combustor liner 112*a*, an inner combustor liner 112*b*, a fueling nozzle (not illustrated) and at least one combustor chute assembly 123. In the embodiment illustrated herein the outer combustor liner 112*a* and the inner combustor liner 112*b* define an annular combustion chamber 124 that is substantially symmetrical about a centerline Z. However, the present invention is not limited to an annular combustor and is applicable with other combustor apparatus configurations such as but not limited to a single can, multi-can and can-annular. The combustor liners 112*a* and 112*b* are spaced from the mechanical housing/case 114 and a passageway 116 provides for the passage of compressed fluid from the compressor section in the general direction of arrow Y.

The combustor liners 112*a* and 112*b* include inner surfaces 126 and 128 respectively that are located within the combustion chamber 124 and are exposed to the hot gases generated during the combustion process. An aperture 121 is formed within at least one of the combustor liners 112*a* and 112*b* for the receipt of the combustor chute 123. The combustor chute 123 is received within the aperture 121 and secured to the combustor liner by a flange 118 and mechanical fastener 119. The present invention contemplates a combustor apparatus having at least one combustor chute 123, and more preferably has a plurality of combustor chutes 123. The position of the individual combustor chutes for a specific design can be determined by techniques such as rig testing and CFD analysis. The combustor chutes 123 may be staggered or aligned with fuel nozzles, spray bars, or any other orifice that delivers fuel within a combustor scheme. Axial orientation of the combustor chutes 123 may be in a single row or multiple rows, which are either staggered or aligned relative to each other.

The combustor chute 123 extends into the combustion chamber 124 and is subjected to the hot gases from the combustion process. Combustor chute 123 is formed of a high temperature resistant material and more preferably the material is suitable for use in an environment where the temperature can be in excess of 1600° C.

Figure 3:
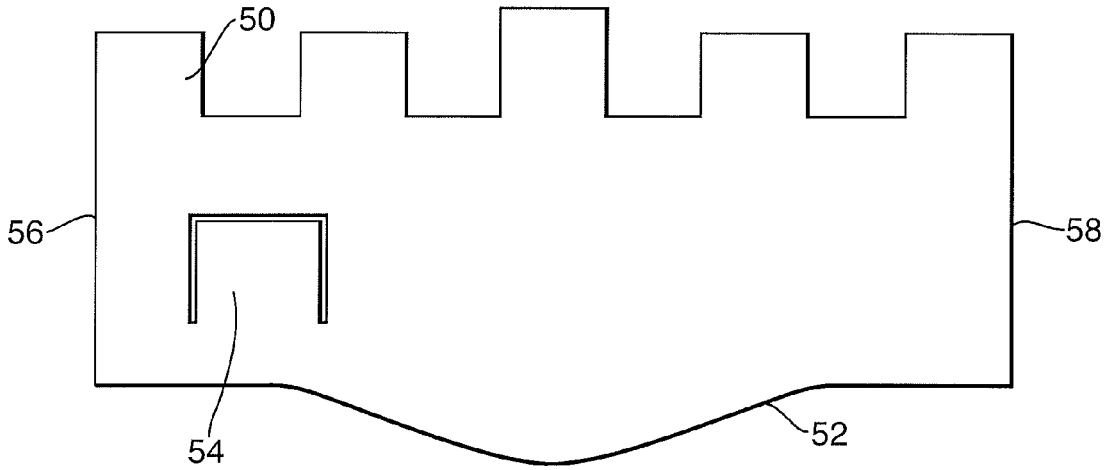
FIG. 3 is a simplified illustration of a blank that may be formed to provide an air inlet according to a first embodiment of the invention.

A first embodiment of combustor chute will be described with reference to FIGS. 3 and 4. A blank is cut from a sheet of metal which is preferably the same material as the combustor itself i.e. a heat resistant alloy e.g. nickel alloy which is cut to the required shape by a flat bed laser or other cutting tool. The blank is formed with at least one tab, and preferably with a series of tabs along one edge and a profiled opposing edge 52. The edges 56, 58, which extend between the tabbed edge and the profiled edge, are parallel to each other.

One or more of the tabs 50 are shaped and sized to engage with a corresponding feature, for example, a means to locate the at least one tab 115 such as a receptacle on or in the combustor wall/lining 112, which ensures the chute is fitted in the correct orientation and prevents rotation once fitted.

One or more flaps 54 (one is shown for clarity) is formed in the body portion of the blank. As will be described in more detail later in the specification, these flaps may be bent to prevent the chute from being released from the combustor once in place.

Figure 4:
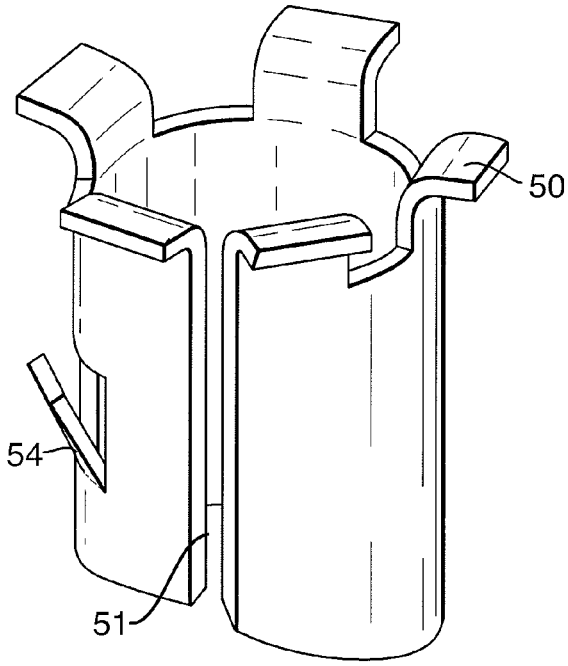
FIG. 4 is a simplified illustration of a formed chute according to the first embodiment of the invention.

FIG. 4 depicts the formed chute. The blank is bent to form a column with the parallel sides 56, 58 being brought together. The sides may be joined, e.g., by welding or a small gap forming a cooling aperture 51 may be left between the sides to allow passage of cooling air through the wall of the chute.

To fix the chute in place, firstly the tabs 50 are bent through 900 and the chute is inserted through the aperture 121 in the wall of the combustor whilst the flap 54 lies in line with the chute wall. The tabs 50 prevent passage of the chute completely through the wall of the combustor and one of the tabs is sized to locate in a corresponding securing feature in the wall of the combustor.

The flap 54 is subsequently pushed outwards by a forming tool inserted into the inside of the chute. The positioning of the flap or flaps secures the chute in position in the combustor.

A liner may be provided to aid the sealing of the chute against the combustor. Beneficially the liner can prevent the tabs and flaps from damaging the combustor.

The chutes get hot during operation and it may be necessary to provide cooling features downstream of the chute to protect portions of the combustor wall or chute which may otherwise not be protected by a film of cooling air. Slots or cooling apertures may be cut into the blank to provide a jet or film of air onto or over the surface to be cooled.

Figure 5:
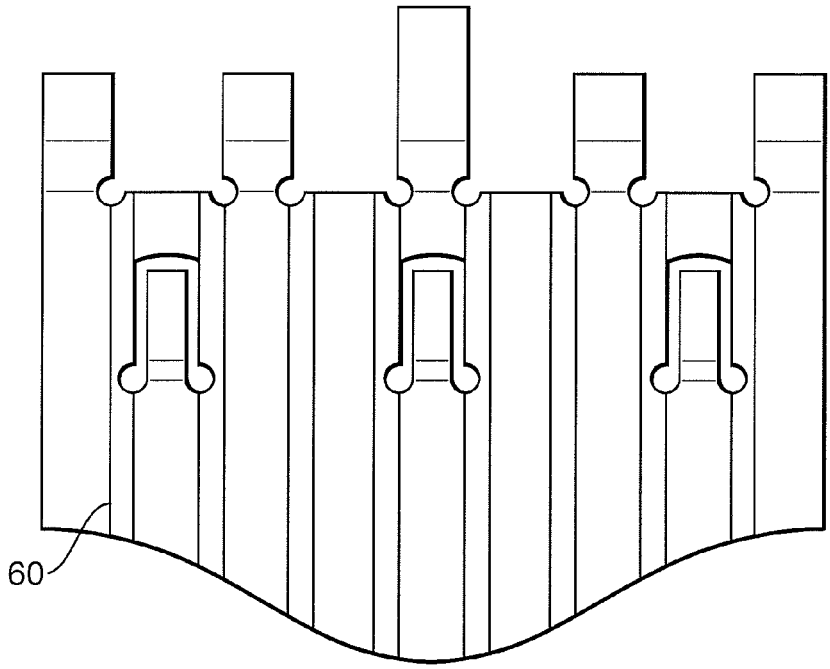
FIG. 5 is a simplified illustration of a blank that may be formed to provide an air inlet according to a second embodiment of the invention.
Figure 6:
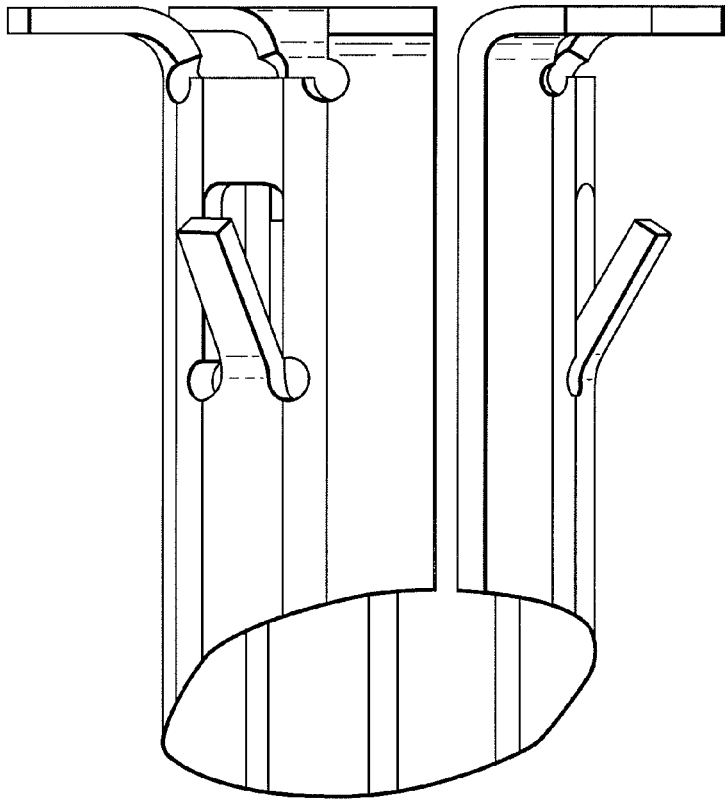
FIG. 6 is a simplified illustration of a formed chute according to the second embodiment of the invention.

A second embodiment of the chute in accordance with the invention is depicted in FIGS. 5 and 6. The blank may be provided with a series of score lines 60 that enable the chute to be formed into a polygonal shape. For smaller dimension chutes the polygon form is easier to manufacture than the circular chute.

In an alternative embodiment the chute is initially provided as a tube which is laser cut to a desired length and laser cut to provide the tabs and flaps. The assembly in the combustor is identical to the method described above.

It will be appreciated that the present invention requires minimal tooling, does not require welding to locate it in position within the combustor. Since the chute is manufactured from sheet material the manufacturing process is cheaper than current casting or machining processes.

It will be further appreciated that the chute can be quickly assembled within the combustor by push fit assembly and that part of the chute may be easily shaped to prevent incorrect fitting. The chute may also be easily removed and replaced.

We claim:

1. A combustor assembly comprising:

a combustor liner having at least one opening therethrough, said combustor liner defining a space adapted for the combustion of a fuel; and a portion of sheet material bent to form a chute enclosing a passageway, the chute having a first end with a plurality of discrete tabs protruding radially outward from the chute, and having a second end inserted through said opening of the combustor liner with the tabbed end outside the combustor liner and with the second end within the combustor liner such that the passageway provides for the passage of a fluid from outside the combustor liner into said space defined by the combustor liner.

2. A combustor assembly according to claim 1, wherein at least one tab provided at the tabbed end of the chute is bent to be substantially normal to the chute, and is engaged with the combustor liner to orientate the chute in a preferred direction relative to the combustor liner.

3. A combustor assembly according to claim 2, wherein the at least one tab is engaged into a receptacle formed in the combustor liner.

4. A combustor assembly according to claim 1, wherein the chute includes at least one flap which is located within the combustor liner and is bent outward from the chute to secure the chute within the combustor assembly.

5. A combustor assembly according to claim 1, wherein at least one cooling aperture is formed from the passageway through the chute for fluid passage to cool the combustor liner or member.

6. A combustor assembly comprising:

a combustor liner having at least one opening therethrough, said combustor liner defining a space adapted for the combustion of a fuel; and a chute cut from a tube and having a first end with a plurality of discrete tabs protruding radially outward from the chute, said chute enclosing a passageway, the chute being inserted through said opening of the combustor liner with the tabbed end outside the combustor liner and with a second end within the combustor liner such that the passageway provides for the passage of a fluid from outside the combustor liner into said space defined by the combustor liner.

7. A combustor assembly according to claim 6, wherein at least one tab provided at the tabbed end of the chute is bent to be substantially normal to the chute, and is engaged with the combustor liner to orientate the chute in a preferred direction within the combustor assembly.

8. A combustor assembly according to claim 7, wherein the at least one tab is engaged into a receptacle formed in the combustor liner.

9. A combustor assembly according to claim 6, wherein the chute includes at least one flap which is located within the combustor liner and is bent away from the passageway to secure the chute within the combustor assembly.

10. A combustor assembly according to claim 6, wherein at least one cooling aperture is formed from the passageway through the chute for fluid passage to cool the combustor liner or chute.

* * * * *